United States Patent [19]

Tulsi et al.

[11] 3,957,669

[45] May 18, 1976

[54] METAL TREATMENT

[75] Inventors: Surindar Singh Tulsi, Guildford; John Stuart Stevenson, Ruardean, both of England

[73] Assignee: Oxy Metal Finishing (Great Britain) Ltd., England

[22] Filed: Feb. 25, 1974

[21] Appl. No.: 445,730

[30] Foreign Application Priority Data

Mar. 1, 1973 United Kingdom ..... 10031/73

[52] U.S. Cl. ..... 252/79.4; 204/34; 204/129.1; 427/309

[51] Int. Cl.[2] ..... C09K 13/06

[58] Field of Search ..... 117/49, 213, 50; 252/79.2, 79.4; 204/34, 129.1; 134/3, 41; 156/18; 427/307, 309

[56] References Cited

UNITED STATES PATENTS

| | | | |
|---|---|---|---|
| 3,349,037 | 10/1967 | Peterson | 252/146 |
| 3,438,901 | 4/1969 | Vassileff | 252/79.3 |
| 3,594,288 | 7/1971 | Reinert | 204/34 |
| 3,725,218 | 4/1973 | Friedel et al. | 204/34 |

*Primary Examiner*—William A. Powell

*Attorney, Agent, or Firm*—Arthur E. Kluegel; Bertram F. Claeboe; Richard P. Mueller

[57] ABSTRACT

Disclosed is a method and composition useful for etching steel prior to metal plating which can be followed by enamelling. The etching composition contains sodium benzene sulphinate and an acid and promotes adhesion of metal and enamel coatings applied over the etched surface.

6 Claims, No Drawings

METAL TREATMENT

The present invention relates to the coating of metal with protective non metallic films and layers, and particularly to the coating of a steel workpiece with vitreous enamel or organic or inorganic coatings e.g. fusing the layers to the surface of the workpiece by heating.

The workpiece conventionally has its surface prepared for the coating process by chemical etching followed by chemical deposition of metal precoating layer. This is a slow process. We have tried increasing the speed of the process by replacing the chemical deposition by electrolytic deposition of the metal precoating layer, and we have also tried replacing the chemical etching by electrolytic etching.

The etching was carried out in dilute sulphuric acid at about 70°C. We have found that when mild steel is being treated the etching results are inconsistent in that the adhesion of an enamel layer varies from batch to batch of steel (as tested by dropping a standard steel ball from a standard height). Whilst we do not know the reason for this, experiments have led us to the belief that trace metals are dissolved out of the steel and then in some manner interfere with the surface of the workpiece so that fluctuations in the surface properties occur from place to place and thus result in inconsistent adhesion. By deliberately adding small amounts of the metals known to be present as impurities in mild steel to the etching acid we have found that addition of copper duplicates the effect found when the etching bath has been used for considerable periods of time namely that enamels subsequently applied over a nickel electro deposit have poor adhesion properties.

We have tried adding a number of organic chemicals to the etching bath to overcome this problem and have discovered that the addition of sodium benzene sulphinate ($C_6H_5SO_2Na$) enables the etching bath to be used for very much longer periods of time thus enabling longer production cycles to be used and economizes on the use of sulphuric acid.

The amounts of interfering metals which are believed to be leached out into the etching bath are likely to be very small because only a very thin layer of steel is removed and the interfering metals are only present in very low concentrations.

We have found that using 7% aqueous sulphuric acid at 70°C for electrolytic etching about 1 gram per liter of sodium benzene sulphinate gives excellent results; however below 0.4 grams per liter the effect is no longer significant.

Thus according to one aspect of the present invention a composition for use in the acidic liquid pretreatment of steel articles, e.g. in chemical or electrolytic etching, prior to surface finishing either as the acidic liquid or as a component of the acidic liquid, comprises as essential ingredient A. an aromatic sulphinic acid e.g. a benzene sulphinic acid or water soluble or acid soluble salts thereof e.g. alkali metal, ammonium or alkaline earth metal salts e.g. sodium or potassium salts, and at least one of the following optional ingredients.

B. an acid effective to etch the steel surface, e.g. a strong mineral acid such as sulphuric, hydrochloric, nitric or phosphoric acids or blends thereof, e.g. in an amount of at least 0.1% by volume concentration based on the total weight of the composition e.g. 2% to 60%, or C. one or more highly surface active perfluoro carbon sulphonic acids or their salts or one or more fluoro carbon sulphonic or sulphuric acid compounds of the general formula $H(CF_2.CF_2.)_x—(CH_2)_yZM$ where $x$ is an integer at least equal to 2, $y$ is an integer from 1 to 3, M is a cation and Z is the $— SO_3 —$ or $— OSO_3 —$ radical in an amount effective to reduce the surface tension of the liquid to below 40 dynes per centimeter e.g. in an amount of at least 0.1 grams per liter based on the total weight of the composition e.g. 0.2 to 2.0 g.p.l. e.g. 0.3 to 0.40 g.p.l.

Ingredient A is preferably sodium benzene sulphinate in an amount of at least 0.1, e.g., 0.2, 0.3 or 0.4 but preferably at least 0.5 grams per liter, e.g., 0.5 to 30, e.g., 0.7 to 4.5 or 0.9 to 3.0 grams per liter based on the total weight of the composition.

This novel composition can be sold as concentrated blends of A blended with B or A blended with C or A with B and C for dilution by the user with water prior to use or in the case of A with C with acid prior to use.

It is preferred to use the ingredients at concentrations in the final bath with A in the range 0.5 to 10 g.p.l. e.g. 0.7 to 1.5, B in the range 2% to 20% w/v e.g. 5% to 15% and C if used in the range 0.1 to 2.0 g.p.l. e.g 0.3 to 0.6 g.p.l.

The composition in the concentrate form of A plus B preferably contains A at a concentration in the range 1.5 to 30 g.p.l. e.g. 2.1 to 4.5 g.p.l. and B at 6% to 60% w/v; e.g. 15 to 45% w/v in the form A blended with C, A at 2.0 to 40.0% w/v e.g. 4.0 to 10% w/v and C at 0.3 to 6.5% w/v e.g. 1.0 to 5.0% w/v and in the form A plus B plus C; A at 1.5 to 30 g.p.l., B at 6% to 60% w/v and C at 0.3 to 6.5% w/v.

Thus more broadly according to the present invention a bath composition for chemically or electrolytically etching mild steel comprises an acid, e.g. aqueous sulphuric acid, effective to etch the metal workpiece and an organic compound effective to reduce the level of redeposition of metallic impurities present in the bath on the etched steel surface.

The invention also extends to an electrolytic etching process in which the workpiece is made the anode and is immersed in accordance with the invention and d.c. current passed through it using insoluble cathodes e.g. of a lead-tin alloy or lead e.g. at a current density of 1 to 100 e.g. 20 to 70 e.g. 40 to 60 amps/sq. foot to remove 0.1 to 10 e.g. 1 to 5 or 2 to 3 grams/sq. foot as well as a chemical etching process in which the workpiece is immersed in the composition.

The invention also extends to a plating process comprising a pretreatment stage in which a metal workpiece is contacted with a bath composition in accordance with the invention and a plating stage in which the pretreated workpiece is contacted with a metal plating composition under conditions effective to plate the workpiece with the metal container in the said metal plating composition e.g. in an amount of at least 10 mg/sq. foot.

The pretreatment preferably comprises an etching process in accordance with the invention and the metal plating composition preferably comprises an electrolytic metal plating composition e.g. an acidic nickel sulphate composition and the workpiece is made the cathode and has a d.c. current passed through it to deposit at least 40 milligrams/sq. ft. e.g. 60 to 120 preferably 80.

The invention also extends to an enamelling process comprising a pretreatment and plating process in accordance with the present invention, and to steel, e.g. sheet or strip whenever etched, plated or enamelled by a process in accordance with the invention.

The invention may be put into practice in various ways and some specific embodiments will be described by way of example only.

EXAMPLE 1

Etching Process

In this example a mild steel workpiece is used. Mild steels typically contain a maximum of carbon of about 0.08%, with manganese 0.45% max., sulphur 0.003% max., phosphorous 0.25% max. Mild steel is made using a proportion of scrap and thus traces of other metals such as copper are liable to occur but at varying concentrations from batch to batch of steel. Thus some batches of mild steel may result in adequate adhesion of enamels whilst others apparantly of the same composition do not.

In this example the mild steel workpiece is submitted to the following sequence of steps.

1. Soak-clean the workpiece in a wetted alkaline cleaner, 50–75 grams/liter, at 70°–95°C for 6 to 12 minutes.
2. Rinse in warm water at 70°C.
3. Rinse in cold running water.
4. Electrolytically-clean the workpiece, using a wetted alkaline cleaner, 50–75 grams/liter, at 70°–95°C for 2 to 6 minutes, using a steel or stainless steel cathode at a current density of 25–50 amps/sq. foot.
5. Rinse in cold running water.
6. Etch the workpiece as the anode in 7% aqueous sulphuric acid containing 1 gram/liter of sodium benzene sulphinate ($C_6H_5SO_2Na$), at 70°C, using an insoluble lead-tin alloy cathode at a current density of 5 amps/sq. decimeter, (50 amps/sq. foot) for 4 to 6 minutes, to remove 20 to 30 grams/sq. meter, 2 to 3 grams/sq. foot.
7. Rinse in cold running water.

Moreover the solution in step 6 can be used continuously (subject to maintaining the sulphinate concentration) up to relatively high iron contents e.g. of at least 100 grams per liter (at which the solution is normally discarded) whilst still producing a product which after the procedure of Examples 2 and 3 gives a product with satisfactory adhesion of the enamel.

When the sodium benzene sulphinate is omitted some grades of steel (the cheaper more impure grades) whilst being etched do not give adequate adhesion even when the etch solution is fresh, whilst with purer grades the quality of the etch falls off sooner.

Thus by use of the present invention enamelled steel articles with good adhesion of the enamel can be obtained using less expensive mild steel as the base material rather than the costlier, more pure grades of steel.

Tests indicate that sodium benzene sulphinate is used up under these conditions at a rate of 0.008 grams per ampere hour.

Satisfactory enamel adhesion results were still obtained even when the etch bath contained as much as 200 g.p.l. of iron. However drying on stains are liable to occur when the iron content is above 150 g.p.l. and is thus preferred to replace the etch bath by fresh material when this level is reached.

EXAMPLE 2

Plating Process

Steps 1 to 7 of Example 1 are repeated and then the following sequence of steps 8 to 13 are carried out.

8. Electrolyte de-smut : to remove carbon in a wetted alkaline solution 50–75 grams/liter, 70°–95°C, as anode at 50 amps/sq. foot for 30 seconds with steel or stainless steel as the cathode.
9. Rinse in cold water.
10. Neutralise by dipping in cold 5% aqueous sulphuric acid for 15 seconds.
11. Rinse in cold water.
12. Nickel-deposition : immerse the workpiece as cathode in an aqueous solution of 80 grams per liter of nickel sulphate ($7H_2O$), 10 grams per liter of ammonium chloride, 20 grams per liter magnesium sulphate ($7H_2O$), 5 grams per liter boric acid, pH 5.3 using nickel anodes at a current density of 2 amps per sq. foot for 2 minutes to produce a deposit of 40 mg/sq. foot.
13. Rinse twice in cold running water.

EXAMPLE 3

Enamelling Process

Steps 1 to 13 of Example 2 are repeated and then the following sequence of steps 14 to 18 are carried out.

14. Immerse in hot aqueous sodium nitrite solution (5 grams per liter) at 90°C.
15. Air dried at 60°C.
16. Apply enamel : as an aqueous emulsion by dipping or spraying the enamel is $SiO_2$ (38.7%), $Al_2O_3$ (7.0%), $B_2O_3$ (22%) fluorine (6%), cobalt oxide (CoO) (0.4%), calcium oxide (0.9%).
17. Dry to leave a coating of the desired thickness (0.002 to 0.003 inches).
18. Heat in air at 800°C for 4 minutes and then allow to cool in air.

The process produces enamel coated workpieces which have satisfactory adhesion of the enamel when a steel cylinder having a ball end three-fourths inch end diameter weighing 2lbs. is dropped from a height of 20 inches.

It has also been found that the use of wetting agents, particularly fluorinated carbon types, namely ingredient C are beneficial to the acidic etch bath.

When used at such a concentration as to reduce the surface tension of the acid etch to below 40 dynes/cm., spraying of the acid during electrolysis is much reduced and etching of low current density areas are improved.

Examples of these compounds are perfluoro butyl sulphonic acid and homologues up to n-lauryl and perfluoro cyclohexane sulphonic acid and substituted homologues thereof and perfluoro napthalene sulphonic acid and $H(CF_2.CF_2)_6CH_2SO_3H$ and $H(CF_2.CF_2)_7CH_2OSO_3Na$.

EXAMPLE 4

Comparison Example

When step 6 of example 1 is replaced merely by immersion of the workpiece in 7% w/v sulphuric acid at 70°C for 5 minutes only low weight losses e.g. of 0.3 to 0.7 g/sq. meter were observed and the results fluctuated widely with varying grades of mild steel.

When the procedures of examples 2 and 3 were carried out products with unsatisfactory adhesion of the enamel resulted.

EXAMPLE 5

Comparison Example

Step 6 was replaced by acidic etch solutions of various types e.g. (5A) 5ml $H_2SO_4$/liter plus 150 g $Na_2SO_4.10H_2O$/liter; (5B) 5% v/v $H_2SO_4$ plus 2% v/v phosphoric acid and (5C) 7% w/v $H_2SO_4$. These were all operated at 50 amps per square foot using an etch time of 30 seconds immersion followed by 3 minutes immersed anodic etching. A weight loss of approximately 2.8 g/sq. ft. resulted with various grades of mild steel, enamel steel e.g. CR2VE, and zero carbon steels. Enamel steels typically contains not more than 0.05% carbon and zero carbon steels typically contain not more than 0.002% C.

The procedure of example 2 was then carried out using a nickel plating bath of the following composition $NiSO_4.6½\ H_2O$ 70 g.p.l. NaCl 15 g.p.l., $MgSO_4$ 12 g.p.l., Boric acid 7 g.p.l at a pH of 5.3 to 5.7 current density 2 amps/sq. ft. temperature 20°C for 2 minutes.

The procedure of example 3 was then carried out using the same conventional enamel fired at 800°C for 4 minutes.

It was found that when this process is carried out repeatedly using the same etch liquid in step 6 the adhesion properties of the enamelled products are no longer consistent.

Possible causes were tested by adding traces of lead, antimony, manganese and chromium to the etch bath of step 6; at concentrations up to 50 ppm no ill effects were noted. However the addition of as little as 20 ppm of copper to the etch bath gave a marked reduction in adhesion of enamelled products for which the steel had been etched in such copper containing baths.

Also when mild steels which gave bad adhesion results with the processes of examples 4 and 5 are used they give good adhesion results with the process of examples 1, 2 and 3.

EXAMPLES 6 to 31

These illustrate a number of alternative compounds. Mild steel panels 3 inches × 3 inches were used, the grade being one which gives poor adhesion using 7% sulphuric acid alone in step 6.

The procedure of example 5, was carried out with each compound at varying concentrations the compounds and concentrations being listed in Table 1 below. The etch bath contained a mixture of 0.3 g.p.l. of potassium salt of perfluoro para ethyl cyclohexyl sulphonic acid and 0.03 g.p.l. of potassium salt of perfluoro N-octylsulphonic acid. The materials were then plated and enamelled as in examples 2 and 3 and the adhesion results quoted are for the enamel.

Table 1

| Example | Compound | Conc. | Adhesion |
|---|---|---|---|
| 6 | Thiourea | 1 g/l | Very poor |
| 7 | Sodium benzene sulphinate | 0.02 g/l | Poor |
| 8 | | 1 gpl | Excellent |
| 9 | Sodium Benzoate | 1 | Poor |
| 10 | | 5 gpl | Poor |
| 11 | p-Sulpho-benzoic acid Mono potassium | 1 | Poor |
| 12 | | 10 gpl | |

Table 1-continued

| Example | Compound | Conc. | Adhesion |
|---|---|---|---|
| 13 | Toluene-p-Sulphonic acid | 1 | Poor |
| 14 | | 10 gpl | |
| 15 | Benzene Sulphonic acid | 1 | Fail |
| 16 | | 10 gpl | |
| 17 | Sodium Benzene Sulphate | 1 | Poor |
| 18 | | 10 gpl | |
| 19 | Sodium Allyl Sulphonate | 0.1 gpl | Poor |
| 20 | | 1.0 gpl | |
| 21 | Sulphanilic Acid | 1 gpl | Poor |
| 22 | | 10 gpl | |
| 23 | EDTA | 1 gpl | Poor |
| 24 | | 10 gpl | |
| 25 | Sulphamic Acid | 1 gpl | Poor |
| 26 | | 10 gpl | |
| 27 | Sodium GLuconate | 1 gpl | Poor |
| 28 | | 10 gpl | |
| 29 | Trisodium citrate | 1 gpl | Poor |
| 30 | | 10 gpl | |

EXAMPLES 31 and 32

The following etching and plating sequence prior to enamelling has been found most satisfactory for a wide range of mild steels, vitreous enamel steels and zerocarbon steels.

EXAMPLE 31

Etching

1. Soak clean as in step 1 of example 1 for 6.5 minutes using a proprietory alkaline soak cleaner.
2. Rinse twice in cold water, 0.5 minutes.
3. Immerse in 2% $H_2SO_4$ at 60°C for 2 minutes.
4. Rinse twice in cold water, 0.5 minutes.
5. Electrolytically clean as in example 1 step 4 at 50 amp/sq. ft. for 2 minutes using a propreitory alkaline electrocleaner.
6. Rinse twice in cold water, 0.5 minutes.
7. Etch as in example 1 step 6 using 0.96 g.p.l. of sodium benzene sulphinate and a mixture of 0.3 g.p.l. of potassium salt of perfluoro para ethyl cyclohexyl sulphonic acid and 0.03 g.p.l. of potassium salt of perfluoro N-octylsulphonic acid, and 30 seconds immersion followed by 3 minutes immersed electrolytic etching. Thus removes 2.5 to 2.8 grams/sq. ft. and provides good adhesion. The 30 second immersion before electrolysis starts produces a more uniform etch particularly in low current density areas.
8. Rinse twice in cold water, 0.5 minutes. This completes the etching.

EXAMPLE 32

Plating

9. Electrolytic desmut as in example 2 step 8.
10. Rinse in cold water for 2 minutes.
11. Neutralize by dipping in 5% $H_2SO_4$ at 20°C for 30 seconds.
12. Rinse in cold water for 0.5 minutes.
13. Nickel plate as in step 12 of example 2 but at a pH of 5.5 and at room temperature to deposit 60 to 120 mg/sq. ft. preferably 80 mg/sq. foot using a plating bath consisting of 70 g.p.l. $NiSO_4.6½\ H_2O$; 15 g.p.l. NaCl; 12 g.p.l. $MgSO_4$; 7 g.p.l. Boric acid.

14. Rinse twice in cold water, 0.5 minutes.
14. Air dry.

This completes the plating step.

The pretreated and plated material may now be enamelled as in example 3 or by any conventional enamelling procedure.

EXAMPLES 33 to 43

These illustrate a range of satisfactory operating conditions for use with examples 31 and 32 with mild steel and are listed in Table 2.

Table 2

| Example | ETCH | NICKEL | DESMUT |
|---|---|---|---|
| | Example 31 step 7 | Example 32 step 13 | Example 32 step 9 |
| 33 | 50 ASF 3.0 min | 2 ASF 2 min | 50 ASF 0.5 min |
| 34 | " | 3 ASF 2 min | " |
| 35 | " | 5 ASF 1 min | " |
| 36 | " | 2 ASF 1 min | " |
| 37 | 100 ASF 1.5 min | 2 ASF 2 min | " |
| 38 | 50 ASF 2 min | " | " |
| 39 | 50 ASF 1 min | " | " |
| 40 | 25 ASF 6 min | " | " |
| 41 | 50 ASF 3 min | " | 50 ASF 2 min |
| 42 | 50 ASF 3.0 min | 2 ASF 2 min | 50 ASF 0.5 min |
| 43 | 50 ASF 3.0 min | 2 ASF 2 min | 500 ASF 0.5 min |

The panels were then enamelled and fired and all had excellent adhesion except examples 35 and 39. Example 35 had powdery enamel at the edges due to high nickel thickness at the edges. Example 39 had poor adhesion and "fish scale" appearance due to too short an etch time.

What we claim as our invention and desire to secure by Letters Patent is:

1. An aqueous acidic etching composition useful for pretreatment of steel articles prior to surface finishing comprising 2% to 6% w/v of a strong mineral acid and 0.5 to 30 grams per liter of benzene sulphinic acid or a water soluble salt thereof.

2. A composition as claimed in claim 1 comprising an aqueous solution of the benzene sulphinic component at a concentration of 0.5 to 10 grams per liter and 2 to 20% weight by volume based on the total volume of the composition of a strong mineral acid.

3. A composition as claimed in claim 1 including at least one highly surface active perfluoro carbon sulphonic acid or salt thereof or at least one fluoro carbon sulphonic or sulphuric acid compound of the general formula $H(CF_2.CF_2.)_x(CH_2)_yZM$ where x is an integer at least equal to 2, y is an integer from 1 to 3, M is a cation and Z is the $-SO_3-$ or $-OSO_3-$ radical, in an amount effective to reduce the surface tension of the liquid to below 40 dynes per centimeter.

4. A composition as claimed in claim 3 in which said highly surface active component is a blend of the potassium salt of perfluoro para ethyl cyclohexyl sulphonic acid and the potassium salt of perfluoro N-octyl sulphonic acid.

5. A composition as claimed in claim 3 which contains 0.3 to 6.5% of the surface active agent.

6. A composition as claimed in claim 3 comprising 0.5 to 30 grams per liter of alkali metal benzene sulphinate, 2% to 60% w/v sulphuric acid and 0.3% to 6.5% w/v of the surface active agent.

* * * * *